US005473862A

United States Patent [19]

Brizzi et al.

[11] Patent Number: 5,473,862

[45] Date of Patent: Dec. 12, 1995

[54] METHOD AND A DEVICE FOR JOINING THE COMPONENT WRAPPERS OF DIVISIBLE PACKS CONTAINING SEVERAL SINGLE PACKETS OF CIGARETTES

[75] Inventors: Marco Brizzi, Zola Predosa; Antonio Gamberini, Bologna, both of Italy

[73] Assignee: G. D S.p.A., Bologna, Italy

[21] Appl. No.: 189,706

[22] Filed: Feb. 1, 1994

[30] Foreign Application Priority Data

Feb. 3, 1993 [IT] Italy ..... BO93A0029

[51] Int. Cl.[6] ..... B65B 35/50

[52] U.S. Cl. ..... 53/447; 53/415; 53/136.1; 53/136.3; 53/136.4

[58] Field of Search ..... 53/53, 202, 540, 53/447, 415, 136.1, 136.3, 136.4; 198/416, 383

[56] References Cited

U.S. PATENT DOCUMENTS

| | | | |
|---|---|---|---|
| 4,858,770 | 8/1989 | Gamberini | 209/535 |
| 4,947,624 | 8/1990 | Cones, Sr. et al. | 53/447 |
| 5,058,363 | 10/1991 | Focke et al. | 53/202 |
| 5,214,901 | 6/1993 | Milliner | 53/540 |
| 5,216,870 | 6/1993 | Boriani et al. | 53/202 |

FOREIGN PATENT DOCUMENTS 937701 9/1963 United Kingdom .

*Primary Examiner*—John Sipos
*Assistant Examiner*—Gene L. Kim
*Attorney, Agent, or Firm*—Cushman Darby & Cushman

[57] ABSTRACT

Divisible packs consisting in two wrappers breasted frontally one with another are conveyed broadside, singly and in succession, to the point of being taken up between paired belt loops carrying teeth which are timed to impinge on the two wrappers and bring them into vertical alignment. Thereafter, the pack draws level with an applicator station where labels are affixed to the now perfectly matched end faces of the wrappers, then passes on to a further station at which correct application of the labels is verified by two pneumatic control elements: these consist in suction cups or nozzles connected to respective transducers which, by sensing changes in the pressure levels registering at the end faces of the wrappers, will detect any pack from which either or both of the labels may be missing.

21 Claims, 3 Drawing Sheets

FIG 3
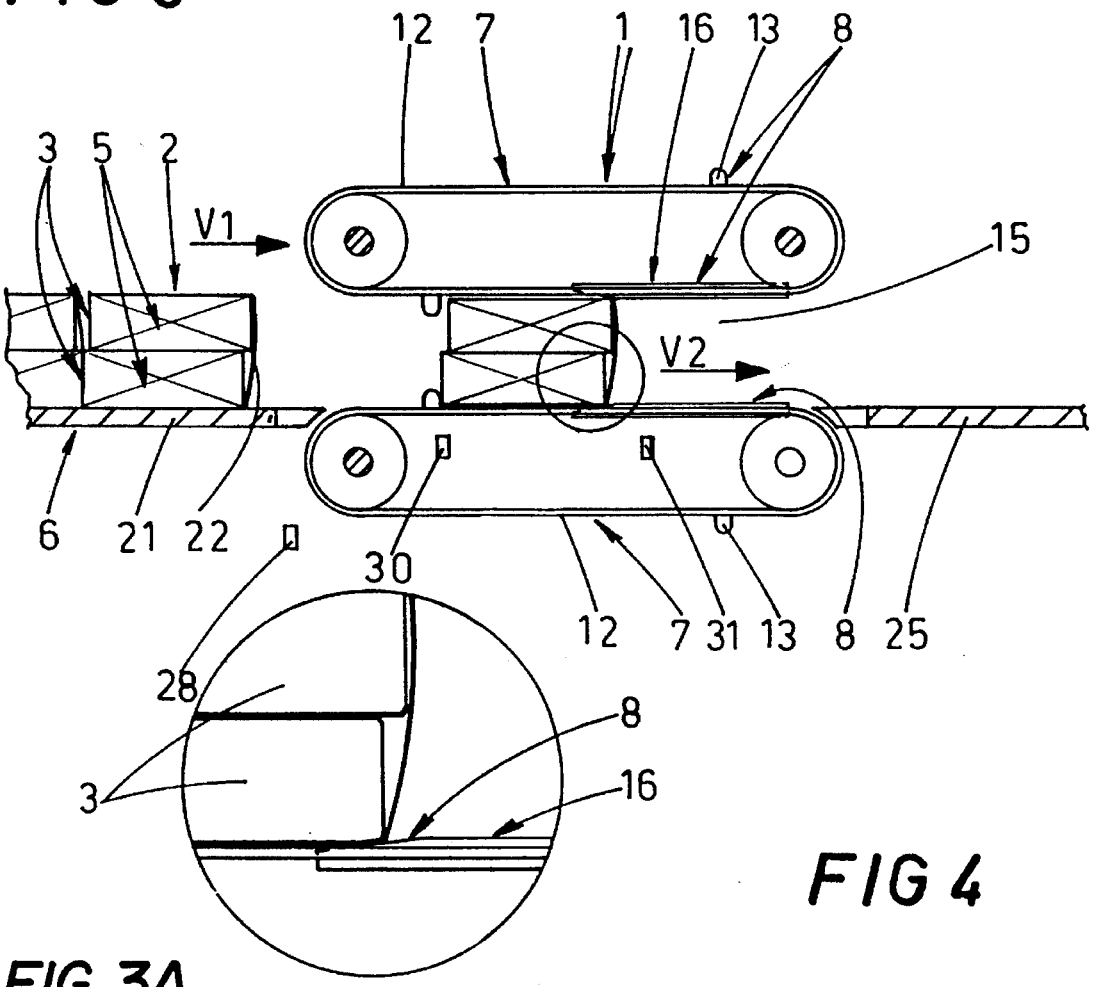
FIG 4
FIG. 3A
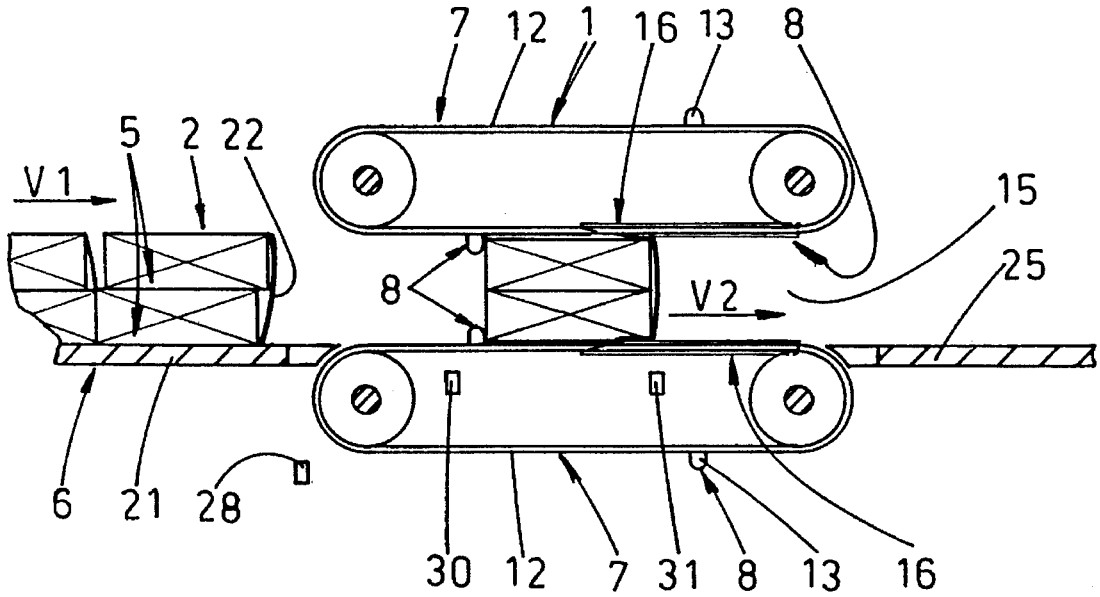

METHOD AND A DEVICE FOR JOINING THE COMPONENT WRAPPERS OF DIVISIBLE PACKS CONTAINING SEVERAL SINGLE PACKETS OF CIGARETTES

BACKGROUND OF THE INVENTION

The present invention relates to a method for joining the component wrappers of a pack of cigarettes that is divisible into at least two packages; each package comprising several single packets of cigarettes. Conventionally, cigarettes are wrapped for general distribution in packs composed of several single packets, normally ten in number, arranged in two, side-by-side, longitudinal rows, each row comprising five packets.

To allow the sale of half the quantity of a normal size pack, that is to say, a substantially enclosed container enveloping just five packets, there are now divisible packs having two distinct wrappers. At the end of the wrapping operation, a divisible pack appears as two wrappers breasted together and connected one to another generally along one of the longitudinal flanks of the pack.

This type of connection allows the divisible pack to be "opened" in the manner of a book, and is realized by means of a flap that extends from one longitudinal flank of at least one of the wrappers in such a way as to enable its attachment to the corresponding flank face of the remaining wrapper.

Before further operations are carried out on the divisible pack, in particular the application of an overwrapping fashioned from transparent material, the two wrappers must be joined securely together. Because the longitudinal connection in question allows a measure of relative movement between the two components, albeit limited, such connection is not able to guarantee faultless execution of the overwrapping operation.

The method most commonly adopted for securing the two wrappers one to another is to affix one or more straddling labels, or indeed any suitable sticker type element with an adhesive material on one side such as will grip both wrappers firmly at once. As to means for verifying the presence and correct application of such labels, typically transparent stickers, one prior art solution is based on the use of labels possessing a refractive index different to that of the wrappers.

By monitoring the refractive index of the pack at the area where the labels are affixed and comparing the monitored value with a value corresponding to the refractive index of the wrappers, it becomes possible to verify whether or not the labels have been applied correctly.

Another notion has been to use labels coated with a special adhesive material detectable by particular instruments, for example optical media operating in the infrared band. Such a solution is marked by an unacceptable level of expense, however, generated not least by the need for specially manufactured labels which are not available through conventional supply channels.

The object of the present invention is to allow joining wrappers of divisible packs simply, swiftly and economically, using transparent labels of any given type, including those purchased through normal commercial channels.

SUMMARY of the INVENTION

The stated object is realized in a method according to the present invention for joining the component wrappers of divisible packs of the type containing several packets of cigarettes. Each pack appears essentially parallelepiped in shape and consists of a pair of distinct wrappers breasted in frontal contact one with another. The method comprises the steps of using feed means to convey the packs in succession parallel one with another in a given feed direction, using applicator means to affix mutual retaining means to at least one divisible face of each pack, positioned in such a way as to engage both wrappers, and monitoring the area of the face selected to receive the mutual retaining means, utilizing pneumatic control means designed to sense the presence of such retaining means. A further object of the invention is to provide a device suitable for the implementation of such a method.

This further object is duly realized in a device according to the present invention for joining the component wrappers of divisible packs of the type containing several packets of cigarettes, wherein each pack consists in a pair of distinct wrappers breasted in frontal contact one with another. The device in question comprises feed means by which the packs are conveyed parallel one with another in a direction normal to their longer axis, applicator means by which mutual retaining means are affixed to the opposite end faces of each pack, pneumatic control means able to verify the presence of the mutual retaining means on a relative face of the pack, and pneumatic transducers, connected to the pneumatic control means, for detecting the difference between measured pressure values and a preset reference value.

BRIEF DESCRIPTION of the DRAWINGS

The invention will now be described in detail, by way of example, with the aid of the accompanying drawings, in which:

FIGS. 2, 3 and 4 are three side elevation views of the device according to the invention, in which certain parts are omitted better to reveal others, showing three respective operating configurations assumed during the step of aligning the wrappers of each pack in the vertical direction;

FIG. 3A is a larger scale fragmentary side elevational view of the region circled in FIG. 3;

DESCRIPTION OF THE PREFERRED EMBODIMENTS

Figure 1:
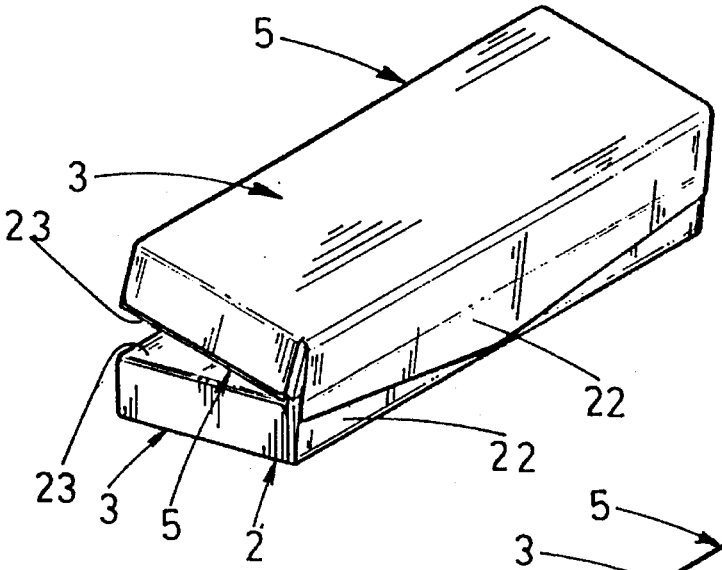
FIG. 1 is a perspective view of the divisible pack in which the component wrappers are rotated about their respective longitudinal cover flaps and as not yet joined together.

Observing FIG. 1 of the drawings, numeral 2 denotes a pack containing several single packets of cigarettes, in its entirety. The pack 2 in question is divisible into at least two packages, each having at least one packet of cigarettes contained therein. Each package is wrapped by distinct wrappers 3 breasted in frontal contact and hinged together by way of respective longitudinal cover flaps 22. According to the method of the present invention, packs 2 are fed parallel one with another along a path normal to their own longitudinal or greater axis, thus advancing broadside in single file. The leading pack 2, or at any rate the pack positioned forwardmost along the feed direction, is separated from the packs following behind, whereupon the component wrappers 3 are aligned vertically in such a way as to match the faces 23 breasted in frontal contact. Thereafter, mutual retaining means 4 are applied to the pack 2, offered to at least one of the faces not occupied by the longitudinal cover flaps 22 and positioned to engage both wrappers 3. Finally, the part of the pack 2 intended to receive the mutual retaining means 4 is exposed to a change in pressure produced by pneumatic control means 10, and the pressure value registering adjacent to each of the mutual retaining means 4 is measured. In the event of the measured value being dissimilar to a preset reference value, a signal is generated such as could be utilized, for example, to activate an ejector device.

To ensure the wrappers 3 are joined more securely one to another, mutual retaining means 4 might be applied to both the end faces 5 of each pack 2. The separation of the leading pack 2 is achieved by inducing its acceleration away from those behind, for example, through use of transfer means 7 operating in such a manner as to propel the pack along the feed direction at a velocity V2 greater than the initial feed velocity V1.

The two wrappers 3 disposed about the respective packages of each pack 2 are brought into vertical alignment by directing the pack 2 forcibly through a passage 15 of which the clearance in the vertical dimension decreases, at least initially, to a value marginally less than the height of the pack. The necessary forcing movement is induced by pushing means 13 impinging on each of the component wrappers 3 and combining to establish a locating and pushing surface disposed perpendicular to the feed direction followed by the pack.

In order to detect the possible omission of one or both mutual retaining means 4, a change in pressure is generated exclusively at the relative points of attachment, such that if either one is missing, the resulting pressure value will drift from the preset reference value by reason of the break between the adjoining end faces of the wrappers 3.

Detecting a pressure value different to the preset reference value, the system may respond simply by ejecting the pack 2 associated with the error, or alternatively by shutting off the device, according to whether the measured value indicates the absence of one only or of both mutual retaining means 4.

A device capable of implementing the method thus far described, denoted by numeral 1 in its entirety in FIGS. 2 to 5, comprises, in sequence, feed means 6 by which the packs 2 are conveyed parallel one with another along a direction normal to the greater dimension of the packs themselves; transfer means 7 by which the packs 2 are advanced along the feed direction; means 8 by which to align the component wrappers 3 of each pack 2 one with another in the vertical direction; applicator means 9 of which the function is to affix mutual retaining means 4 to the two end faces 5 of each pack 2 in such a way as to engage both wrappers 3; means or elements 10 capable of generating a change in pressure localized on the areas to which the mutual retaining means 4 are affixed, and pneumatic transducers 11 such as will measure the pressure value registering at the areas intended to receive the mutual retaining means 4 and allow the detection of any difference between the measured value and a preset reference value. The operation of the entire device 1 is governed by programmable monitoring and control means 29 of conventional embodiment.

The feed means 6 are conventional in embodiment, and illustrated only in part in FIGS. 2 to 5, which show a table 21 on and along which the packs are supported and conveyed.

Figure 5:
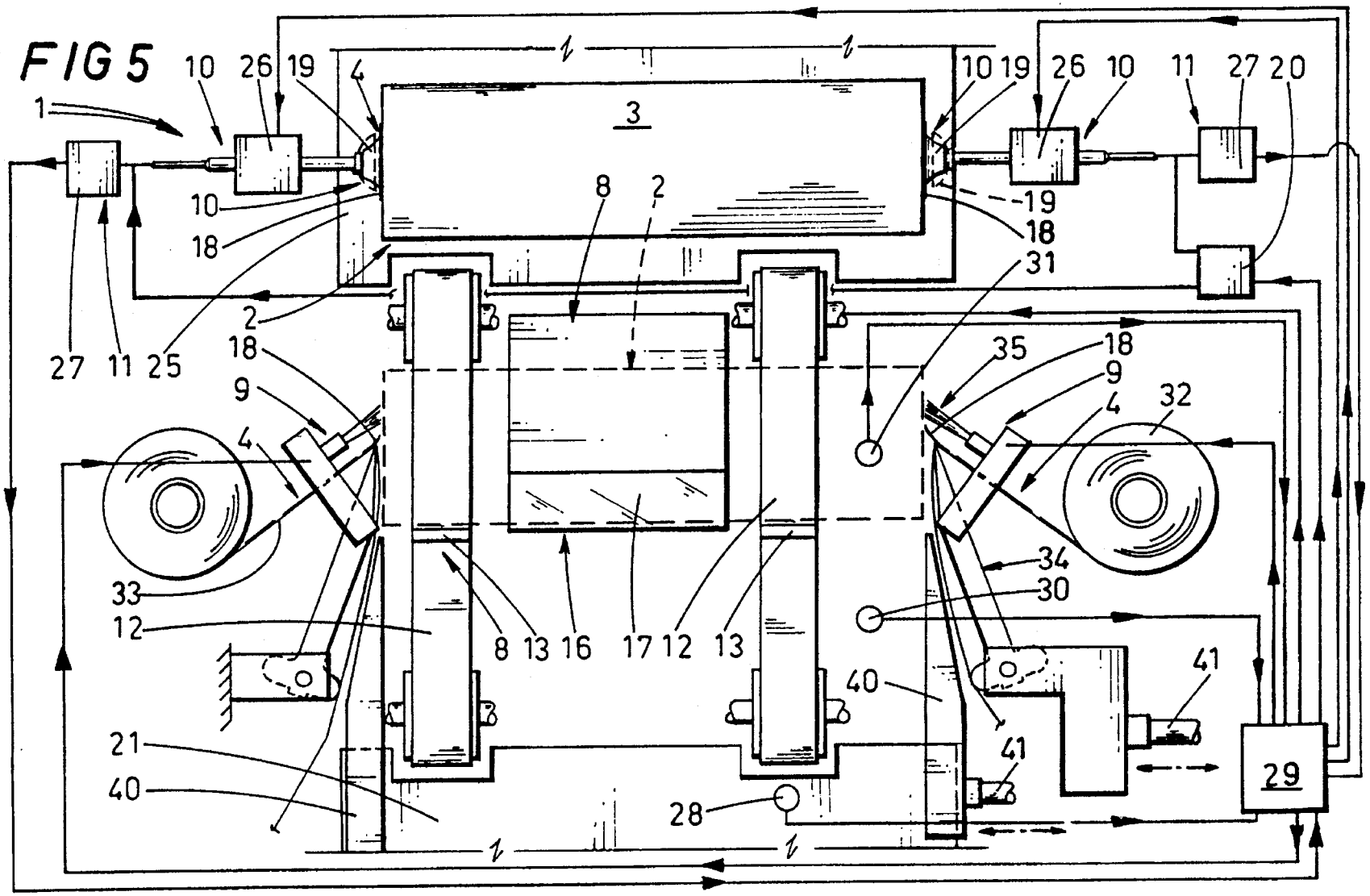
FIG. 5 shows the device of FIGS. 2 to 4 in plan view.

The transfer means 7 consist in a top pair and a bottom pair of conveyor belts 12 positioned beyond the supporting and conveying table 21 in the feed direction, by which the packs 2 are carried forward at a velocity V2 greater than the velocity V1 of the feed means 6. The belts 12 of the top pair are disposed directly above those of the bottom pair, which serve also as a supporting surface occupying the same plane as the table 21 of the feed means 6. The distance between the top and bottom pairs of belts 12 is greater than the height of one pack 2 to ensure that the pack is not compressed between the belts, for reasons that will become evident in due course. Each single belt 12 carries two pushing teeth 13 positioned in such a way as to divide the developable length of the belt into two sections of equal length. The teeth 13 combine to establish two locating and pushing surfaces which are disposed perpendicular to the feed direction as long as the teeth 13 remain in movement along the rectilinear branches of the paired belts 12. The top and bottom pairs of belts 12 are set in motion by respective drive means, not shown in the drawings, of which the operation will be interlocked to the monitoring and control means 29 (as illustrated in FIG. 5). The activation of the conveyor belts 12 is controlled by second sensing means 30 designed to verify the presence of a pack 2 occupying an incoming position on the belts 12, whilst the belts 12 are shut off by first sensing means 28 of which the operation will be explained in greater detail in due course. Also associated with the transfer means 7 are two opposing plates 16 positioned between the belts 12, one above the other, parallel with the rectilinear branches and establishing a passage 15. The initial portion of each plate 16, i.e. the part positioned nearer to the table 21 of the feed means 6, affords a bevelled edge 17 angled in such a manner that the height of the passage 15 reduces along the portion occupied by the bevel surfaces from a value greater to a value less than the height of a single pack 2. The minimum clearance afforded by the passage 15 is sufficient to pull up and arrest a pack 2 carried forward by the belts 12 and not as yet subjected to the pushing action of the teeth 13. As discernible from FIGS. 3 and 4, in particular, the teeth 13 and the passage 15 together provide the aforementioned means 8 by which each two wrappers 3 are aligned vertically during the progress of the respective pack 2 through the conveyor belts 12.

Installed on each side of the conveyor belts 12, the applicator means 9 (conventional in embodiment and therefore described no further) are designed to affix a label 18, constituting the mutual retaining means 4, to each end face 5 of successive packs 2. The parts of each of the applicator means 9 shown in FIG. 5 includes a roll 32 of continuous strip backing material 33 carrying the labels 18 on one face, a diverter 34 over which the backing strip 33 is indexed, and a compression element 35 positioned beyond the diverter 34 in the indexing direction.

The function of the compression element 35, which might be a brush, by way of example, is to press the label 18 against the end face 5 of the pack 2 and thus assure its firm attachment.

The backing strip 33 is advanced intermittently at identical velocity to and in convergence with the conveyor belts 12, its reverse face, i.e. the face without the labels 18, riding over the diverter 34. More exactly, the strip 33 is drawn over an edge afforded by the diverter 34 and doubled back in a direction opposed to that of the conveyor belts 12. Thus, the labels 18 are caused to peel from the backing strip 33 of their own accord once beyond the diverting edge, and attach gradually to the adjacent end face 5, as illustrated in FIG. 5.

Figure 6:
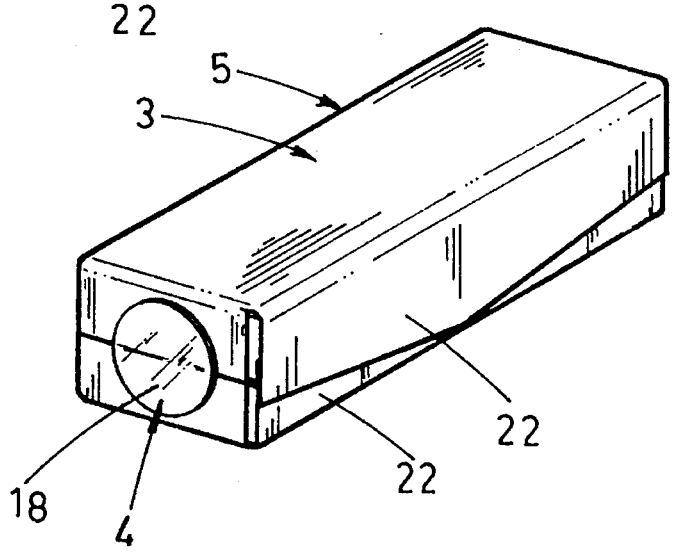
FIG. 6 is a perspective view of the divisible pack in which the component wrappers are breasted in frontal contact and joined together with labels.
Figure 2:
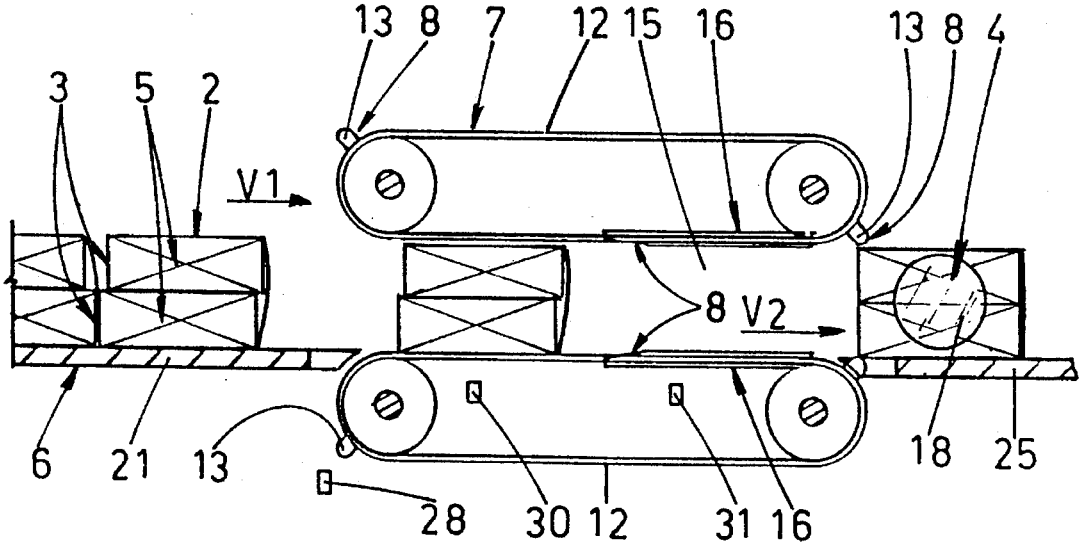

The applicator means 9 are positioned at a height such that each label 18 will enter into contact with both wrappers 3 of a pack 2, as discernible from FIGS. 2 and 6. The activation of the applicator means 9 is determined by third sensing means 31 which verify the arrival of a pack 2 between the applicator means 9 on each side.

Numeral 40 denotes one of a pair of restraints positioned on each side of the path followed by the packs 2 toward and through the belts 12, preceding the applicator means 9, and capable of movement at least on one side through the agency of respective adjustment means 41 which also serve to determine the position of the applicator means 9. The device also comprises a further table 25 positioned beyond the conveyor belts 12 and serving to receive the packs 2 with their respective labels 18 attached, and suitable means by which to stop the advancing packs, located near to the table 25, such means not being illustrated, as it is conventional in embodiment. Both the receiving table 25 and the supporting and conveying table 21 are embodied with portions (not denoted by any number) cut away to accommodate the passage of the conveyor belts 12 and their pushing teeth 13, as illustrated in FIGS. 2 and 5.

The aforementioned pneumatic control means 10 are disposed on each side of the receiving table 25, and serve to generate a change in pressure. Such means comprise a pair of suction cups 19 connected to a source of negative/positive pressure 20, as in the example of FIG. 5, or a pair of nozzles 14 each delivering a jet of gas under pressure, likewise connected to a relative pressure source, which in the interests of simplicity is denoted 20 whether for suction cups 19 or for the nozzles 14. Supplied from the relative source 20 with a pressurized gas, preferably air, the nozzles 14 will be connected to a pneumatic transducer 11 which in the example of FIG. 5 is designed to produce an electrical output signal proportional to the pressure registering in the area adjacent to the label 18.

Figure 7:
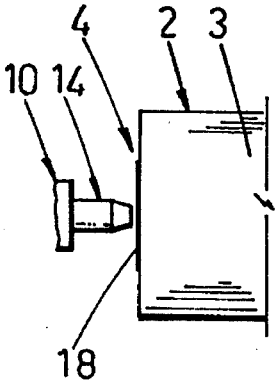
FIG. 7 shows one possible embodiment of a detail of the device as shown in FIGS. 2, 3, 4 and 5.

As discernible from FIG. 7, the extremity of the nozzle 14 is positioned adjacent to the pack 2, or more exactly to the line of contact between the two wrappers 3, and disposed in such a way that the jet will be directed against the end face 5. In effect, if the nozzle 14 is supplied with pressurized air at a steady rate of flow, the presence of a pack 2 in the path of the jet produces a rebound or return pressure such as can be picked up by the pneumatic transducer 11. Indeed it has been found in practice that even a discontinuous feature, such as the area of the joint between the two component wrappers of a pack 2, occasions a marked variation in the rebound pressure.

The suction cups 19 are coupled to reciprocating drive means 26 and capable thus of movement in an axial direction. Each of the cups 19 is connected to a respective pneumatic transducer 11 which, by way of example, might consist in a vacuum meter 27.

Referring to FIGS. 2, 3, 4 and 5, the packs 2 are advanced along the table 21 of the feed means 6 at a given velocity V1. The moment that the leading pack 2, i.e. the first to run off the feed means 6, enters within range of the first sensing means 28, which are connected to the monitoring and control means 29, the conveyor belts 12 will be activated. With the belts 12 running ultimately at full speed, their conveying velocity V2 will be greater than the velocity V1 of the feed means 6, such that the leading pack 2 is taken up onto the bottom pair of belts 12 and advanced at the greater velocity V2, accelerating and separating from the packs behind (see FIG. 2). The pack 2 comes to a halt on entering into contact with the bevelled edges 17, while the bottom conveyor belts 12 continue to run beneath.

In the event that one of the component wrappers 3 may be further forward than the other, as shown in FIGS. 2, 3 and 4, the pack 2 remains lodged against the bevelled edges 17 until the point at which the rearwardmost wrapper 3, in this instance the lower of the two, is engaged by a pair of teeth 13 (see FIG. 3) and carried forward into vertical alignment with the wrapper 3 uppermost, thereby matching the two faces 23 breasted in frontal contact.

The wrappers 3 now advance together as one, at the velocity V2 of the belts 12 (see FIG. 4), and are directed between the applicator means 9. At such time the pack 2 will trigger the second sensing means 30 and thus cause the monitoring and control means 29 to activate the applicator means 9. The applicator means will then proceed to affix a label 18 to each of the two end faces 5 as illustrated in FIG. 5, where a pack 2 undergoing this particular step is indicated in phantom lines. Thereafter, the pack 2, with labels 18 affixed as shown on the right of FIG. 2, is directed onto the receiving table 25. Once the forwardmost teeth 13 have ceased to impinge on the pack 2, the remaining teeth 13 will pass over the first sensing means 28, with the result that the conveyor belts 12 are shut off and the reciprocating drive means 26 activated (see FIG. 5, where the pack 2 is shown in continuous lines). The suction cups 19 are now brought to bear against the end faces 5 of the pack 2 and, at the same time, the monitoring and control means 29 will activate the positive/negative pressure source 20, in this instance to generate suction, followed by the vacuum meters 27. The pressure value measured through each of the vacuum meters 27 is compared by the monitoring and control means 29 with a preset reference value indicating the correct application of the label 18.

As discernible from FIG. 5, the label 18 is larger than the mouth of the suction cup 19, thus allowing a margin of tolerance in positioning when the cup is offered to the label.

If a label 18 has not been affixed, the surface to which the suction cup 19 is offered will not be continuous by reason of the break line between the adjoining end faces of the single wrappers 3, with the result that air can pass across the end face 5 and into the cup 19. In the event that the measured pressure value is different to the reference value, the system can be programmed either to eject the defective pack 2 at a successive station or to stop the device 1, thereby allowing immediate removal of the pack 2.

Where the pneumatic control means 10 are of a type using nozzles 14, it will be evident, in the light of the foregoing description, that the absence of a label 18 occasions a significant variation in the wave of pressure rebounding from the end face 5 of the pack 2; this is duly sensed by the pneumatic transducer 11 and the corresponding output signal is supplied to the monitoring and control means 29, which will respond by executing the same procedures as described already for the suction cups 19. This being the case, FIG. 7 shows neither the pneumatic transducers 11 nor the pressure source 20 nor the monitoring and control means 29.

The stated objects are realized according to the present invention, in a method that is practical and simple to implement, besides being economical and allowing the use of any type of label.

What is claimed is:

1. A method of joining at least two packages of cigarettes, each said package containing at least one cigarette packet and wrapped by a respective exterior wrapper, comprising the steps of:

orienting the packages in abutting, detachably connected relation with one another with the leading faces thereof at least slightly out of alignment with one another;

moving said packages leading face first in a predetermined direction;

aligning said leading faces by continuing to move said packages through a passage having a dimension less than the combined dimension of said abutting packages so that the said packages are moved relative to one another while retaining said detachably connected relation therebetween; and fixing said packages to one another after said leading faces are aligned in a manner which inhibits said leading faces from moving out of alignment.

2. The method according to claim 1, further comprising the steps of:

utilizing a mutual retaining member for fixing the packages to one another after the leading faces are aligned; and monitoring the presence of said mutual retaining member at areas of said packages at which said mutual retaining member is to fix said packages to one another.

3. A device for joining at least two packages of cigarettes, each said package containing at least one cigarette packet and wrapped by a respective exterior wrapper, said device comprising:

feed means for feeding abutting, detachably connected packages of cigarettes leading face first in a predetermined direction, said packages having said leading faces thereof least slightly out of alignment with one another;

alignment means comprising a passage having a dimension less than the combined dimension of said abutting packages for aligning said leading faces of said packages as said feeding means continue to feed the abutting packages while retaining said detachably connected relation between said packages; and applicator means for fixing a retaining member to said packages after said leading faces are aligned so as to inhibit said leading faces from moving out of alignment.

4. The device according to claim 3, further comprising:

pneumatic control means for determining the presence of said retaining member fixed between said packages.

5. The device according to claim 4, further comprising:

pneumatic transducers connected with said pneumatic control means for detecting a difference between pressure values applied by said pneumatic control means to at least one of said packages and a predetermined pressure value.

6. A method as in claim 2, comprising the further step of distancing said at least two packages from other packages by moving said at least two packages at a greater speed than said other packages.

7. A method as in claim 2 wherein said aligning step is accomplished by use of pushing means for pushing on trailing faces of each of said packages.

8. A method as in claim 7, wherein said aligning step is further accomplished by two substantially horizontal and mutually parallel plates set apart at a distance marginally less than the height of said packages and defining a passage therebetween through which the packages are directed forcibly by the action of the pushing means.

9. A method as in claim 2, wherein said mutual retaining member is affixed to faces of said packages disposed parallel to the feed direction.

10. A method as in claim 2, wherein pneumatic control means is utilized for monitoring the presence of said mutual retaining member and comprises at least one suction cup connected to a source of negative pressure, and pneumatic transducers connected to the suction cup.

11. A method as in claim 2, wherein pneumatic control means is utilized for monitoring the presence of said mutual retaining member and comprises at least one nozzle emitting a jet of pressurized gas, and pneumatic transducers connected to the nozzle.

12. A method as in claim 2, comprising the further step of bringing the packages to a standstill at a point within the operating compass of pneumatic control means for monitoring the presence of said mutual retaining member.

13. A method as in claim 1, wherein said detachably connected relation between said packages is established by a longitudinal flap extending from one of the two leading faces.

14. A device as in claim 3, further comprising transfer means for distancing said at least two packages from other packages.

15. A device as in claim 3, wherein said alignment means comprises pushing means for engaging trailing faces of said packages so as to align said leading and trailing faces of said packages, respectively.

16. A device as in claim 14, wherein said transfer means includes at least one pair of mutually opposed conveyor belts disposed one directly over the other on opposite sides of a path followed by said packages and set in motion at a conveying velocity greater than a conveying velocity of the feed means.

17. A device as in claim 16, wherein said alignment means comprises pushing teeth associate with the conveyor belts, said pushing teeth extending outwardly from the conveyor belts in such a way as to impinge on rearward faces of said packages, said conveyor belts defining a passage extending therebetween along the trajectory of the pushing teeth, said alignment means further comprising two horizontal and parallel plates disposed along said passage and set apart at a distance marginally less than a height of said packages.

18. A device as in claim 17, wherein said transfer means includes two pairs of mutually opposed conveyor belts defining said passage therebetween, said plates of the alignment means having opposing respective leading bevelled edges designed to reduce the height of said passage to less than a corresponding dimension of said packages.

19. A device as in claim 3 further comprising pneumatic control means for determining the presence of said at least one retaining member and including at least one suction cup connected to a source of negative pressure, and wherein pneumatic transducers are connected to the suction cup.

20. A device as in claim 3, further comprising pneumatic control means for determining the presence of said at least one retaining member and including at least one nozzle emitting a jet of pressurized gas, and wherein pneumatic transducers are connected to the nozzle.

21. A device as in claim 3, wherein said applicator means is designed to supply and to affix a label or sheet material coated with an adhesive substance, to each end face of said packages.

* * * * *